US006824366B2

(12) United States Patent
Nagasaka et al.

(10) Patent No.: US 6,824,366 B2
(45) Date of Patent: Nov. 30, 2004

(54) FUEL PUMP WITH A TERMINAL PLATE CONNECTOR AND MEANS FOR SECURING THE PLATE IN PLACE

(75) Inventors: Kenzo Nagasaka, Obu (JP); Yoshihiro Takami, Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 71 days.

(21) Appl. No.: 10/324,853

(22) Filed: Dec. 20, 2002

(65) Prior Publication Data

US 2003/0118462 A1 Jun. 26, 2003

(30) Foreign Application Priority Data

Dec. 25, 2001 (JP) ..... 2001-390966

(51) Int. Cl.[7] ..... F04B 35/04

(52) U.S. Cl. ..... 417/423.1; 417/410.1; 417/423.3; 310/71; 310/88; 310/89

(58) Field of Search ..... 417/410.1, 423.1, 417/423.3; 310/71, 89, 88, 87; 439/926

(56) References Cited

U.S. PATENT DOCUMENTS 3,979,615 A * 9/1976 Neff ..... 310/71
4,361,773 A * 11/1982 Mokrzycki ..... 310/71
4,845,393 A * 7/1989 Burgess et al. ..... 310/51
5,633,542 A * 5/1997 Yuhi et al. ..... 310/40 MM
5,697,769 A * 12/1997 Kobman et al. ..... 417/410.1
5,952,763 A * 9/1999 Bruhn ..... 310/238
6,091,172 A * 7/2000 Kakinuma et al. ..... 310/71
6,203,293 B1 * 3/2001 Yamamoto et al. ..... 417/423.1
6,244,837 B1 * 6/2001 Williams et al. ..... 417/423.7
6,339,272 B1 * 1/2002 Sato ..... 310/87
2002/0102166 A1 * 8/2002 Keyster et al. ..... 417/371
2003/0091446 A1 * 5/2003 Ikeda et al. ..... 417/410.1

FOREIGN PATENT DOCUMENTS

JP 1144270 2/1999

* cited by examiner

*Primary Examiner*—Justine R. Yu
*Assistant Examiner*—Emmanuel Sayoc
(74) *Attorney, Agent, or Firm*—Baker Botts LLP

(57) ABSTRACT

A fuel pump in which a terminal plate can be liquid-tightly mounted to a body upper and prevented from being dislodged from the body upper without the need of other component parts is provided. The terminal plate is formed with a cut and raised portion for preventing dislodging. When the terminal plate is inserted into a terminal plate through-hole having a step portion, a projection and a press-fit portion, the cut and raised portion is closed by being pressed with the projection and allowed to reach the step portion without contacting the press-fit portion. Then, the cut and raised portion returns to its natural configuration. Thus, the terminal plate is prevented from being dislodged to fall into the fuel pump. Because the press-fit portion is not damaged when the terminal plate is inserted, the terminal plate can be placed in liquid-tight contact with the body upper block.

1 Claim, 10 Drawing Sheets

FUEL PUMP WITH A TERMINAL PLATE CONNECTOR AND MEANS FOR SECURING THE PLATE IN PLACE

BACKGROUND OF THE INVENTION

1. Field of the Invention

The present invention relates to a fuel pump adapted to suck in and discharge a fuel such as gasoline. More specifically, the present invention relates to a structure for liquid-tightly securing a terminal plate to a body upper for closing one end of the fuel pump body.

2. Discussion of Related Art

There is known a fuel pump in which a fuel pump part and a driving motor part are mounted into an approximately cylindrical housing to form a fuel pump body, and a body upper is secured to an open end of the cylindrical fuel pump body that is remote from the fuel pump part to close the open end. This type of fuel pump uses a terminal plate to connect the motor part to an external power supply. The terminal plate is disposed to extend through the body upper. The brush of the motor part is connected to a portion of the terminal plate that is inside the body upper. A connector for connecting to the external power supply is connected to a portion of the terminal plate that is outside the body upper.

The terminal plate needs to be liquid-tightly secured to the body of the body upper (hereinafter referred to as "body upper block"). Therefore, it is general practice to insert-mold a metallic terminal plate into the body upper block when injection-molded from a resin material. Japanese Patent Application Unexamined Publication (KOKAI) No. Hei 11-44270 discloses a technique wherein a terminal plate is secured by the following method instead of employing the insert molding process. That is, a terminal plate insertion hole is previously provided in a body upper block when molded from a resin material. Thereafter, a terminal plate is press-fit into the insertion hole, which has been formed in the body upper block.

SUMMARY OF THE INVENTION

The conventional practice of insert-molding a metallic terminal plate into a body upper block when molded from a resin material enables the terminal plate and the body upper block to contact each other in a liquid-tight state. However, the production cost increases unfavorably.

The technique wherein a terminal plate is press-fit into an insertion hole previously formed in a body upper block when molded from a resin material has a possibility of the terminal plate becoming dislodged from the body upper block. To avoid this problem, an extra component such as a coil is needed. Accordingly, the costs also increase unfavorably.

The present inventors conceived of a structure in which a sidewardly projecting portion having springy properties is formed on the terminal plate, thereby enabling the terminal plate to be mounted and prevented from being dislodged simply by press-fitting the terminal plate into the body upper block. However, our experiments revealed that the projecting portion for preventing dislodging damages the body upper block when the terminal plate is press-fit thereinto, so that the terminal plate cannot be placed in liquid-tight contact with the body upper block. It is difficult to prevent the terminal plate from being dislodged while ensuring the required liquid-tightness.

The present invention has overcome the above-described difficulty and realized a structure in which the terminal plate is mounted to the body upper block so as to be prevented from being dislodged simply by press-fitting the terminal plate into the body upper block, and the terminal plate is placed in liquid-tight contact with the body upper block.

In the present invention, a cut and raised portion is formed on the terminal plate. The term "cut and raised portion" as used herein means a structure formed by making a U-shaped cut in a plate-shaped member and bending a portion of the plate-shaped member surrounded by the U-shaped cut to turn about the side left uncut. The bent portion has springy properties. The cut and raised portion is used to prevent the plate-shaped member as inserted into a slit from being dislodged. When the plate-shaped member is inserted into the slit in such a manner that the end of the bent portion closer to the connected side is the leading end, the sidewardly projecting portion is pressed closed by the wall of the slit and allowed to pass through the slit in the closed state. After passing through the slit, the closed portion is allowed to project sidewardly by the springy properties. Once it has projected, the sidewardly projecting portion disables the plate-shaped member from coming out of the slit.

The cut and raised portion offers an excellent dislodging preventing effect despite its simple structure. However, when this structure is applied to the engagement between the terminal plate and the body upper block to which the present invention is directed, the cut and raised portion provided on the terminal plate may damage the body upper block when the terminal plate passes through a through-hole for insertion of the terminal plate, which is provided in the body upper block. Therefore, the conventional structure employing the cut and raised portion cannot be used as it is.

The fuel pump according to the present invention solves the above-described technical problems. The fuel pump has an approximately cylindrical fuel pump body in which a fuel pump part and a driving motor part are mounted. The fuel pump further has a body upper for closing one end of the fuel pump body. The body upper has a body upper block made of a resin material and a terminal plate extending through the body upper block. The terminal plate has, in order from the side thereof remote from the fuel pump body, a connector fitting portion projecting from the body upper block to the outside of the fuel pump; a cut and raised portion opening toward the fuel pump body; and a thick-walled portion greater in thickness than the connector fitting portion. The body upper block has an outer shape for closing the one end of the approximately cylindrical fuel pump body. The body upper block further has a terminal plate through-hole. The terminal plate through-hole has, in order from the side thereof remote from the fuel pump body, a step portion for abutting against the cut and raised portion opening toward the fuel pump body; a projection for contacting the cut and raised portion to close it; and a press-fit portion for liquid-tightly contacting the thick-walled portion of the terminal plate.

In the fuel pump according to the present invention, the thick-walled portion of the terminal plate is pressfit into the press-fit portion of the body upper block to bring the thick-walled portion and the press-fit portion into liquid-tight contact with each other, thereby ensuring the required liquid-tightness between the terminal plate and the body upper block. In addition, the terminal plate is formed with a cut and raised portion for preventing dislodging, and the terminal plate through-hole provided in the body upper block is formed with a step portion engageable with the cut and raised portion of the terminal plate to disable the terminal plate from coming out of the body upper block.

When the terminal plate is inserted into the terminal plate through-hole from the fuel pump body side of the body upper block, the cut and raised portion is closed by being pressed with the inner wall of the terminal plate through-hole. When the terminal plate is further inserted, the cut and raised portion reaches beyond the forward end of the step portion and opens to engage with the step portion. Once this state has been established, the terminal plate is disabled from being pushed back toward the fuel pump body.

If the cut and raised portion of the terminal plate contacts the press-fit portion of the body upper block when it passes through the terminal plate through-hole of the body upper block, the press-fit portion may be damaged. In such a case, the terminal plate cannot be placed in liquid-tight contact with the body upper block. In the present invention, however, the cut and raised portion of the terminal plate passes through the terminal plate through-hole without contacting the press-fit portion in a state where the cut and raised portion is kept closed by contacting the projection. Therefore, there is no possibility of the cut and raised portion damaging the wall surface of the press-fit portion. Accordingly, the thick-walled portion of the terminal plate and the press-fit portion of the body upper block can be placed in liquid-tight contact with each other, and the terminal plate can be prevented from being dislodged without using other component parts.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

First, a technique attempted by the present inventors in the course of accomplishing the present invention will be described for the convenience of understanding. The present invention was created through the attempts made by the present inventors.

Figure 8A:
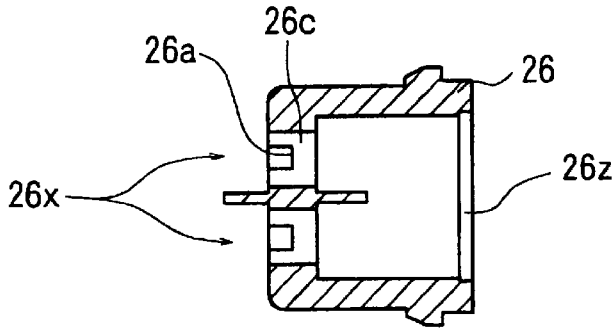
FIG. 8A is a sectional view of the reference example, showing a part corresponding to FIG. 3A.
Figure 8B:
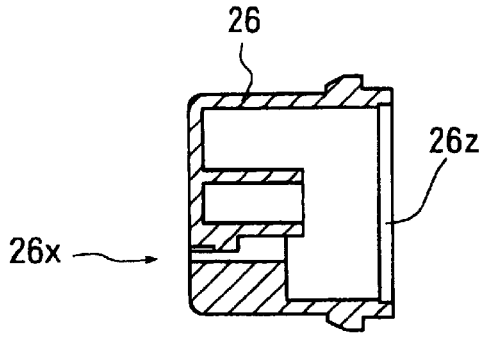
FIG. 8B is a sectional view of the reference example, showing a part corresponding to FIG. 3B.
Figure 8C:
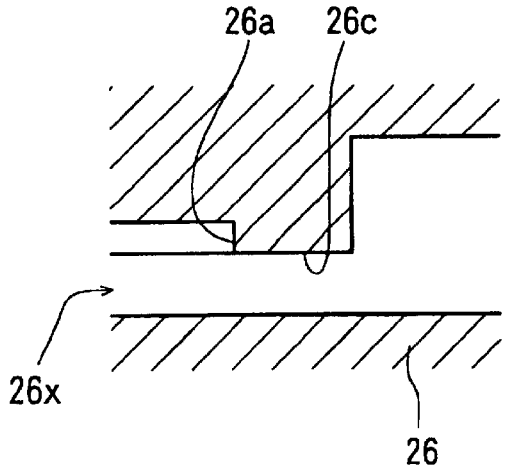
FIG. 8C is an enlarged view of an essential part of FIG. 8B.

A fuel pump has a fuel pump body (not shown) comprising a fuel pump part and a motor part for driving it, which are mounted into a cylindrical housing. An end of the fuel pump body remote from the fuel pump part is open. FIGS. 8A to 8C show a body upper block 26 made of a resin material. The body upper block 26 is secured in the opening at the end of the fuel pump body to close the opening.

Figure 7A:
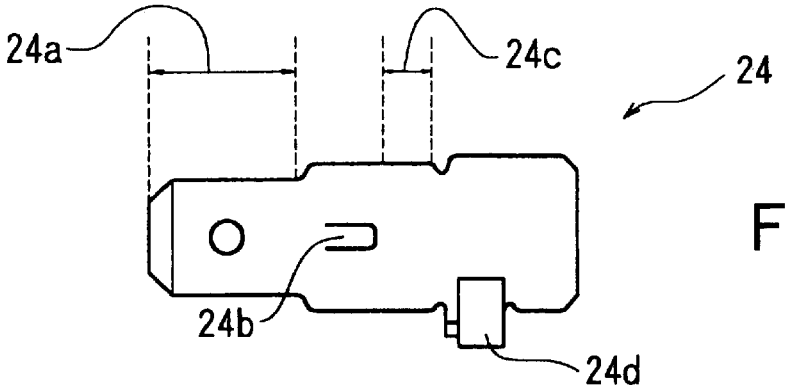
FIG. 7A is a plan view of a terminal plate of a reference example.
Figure 7B:
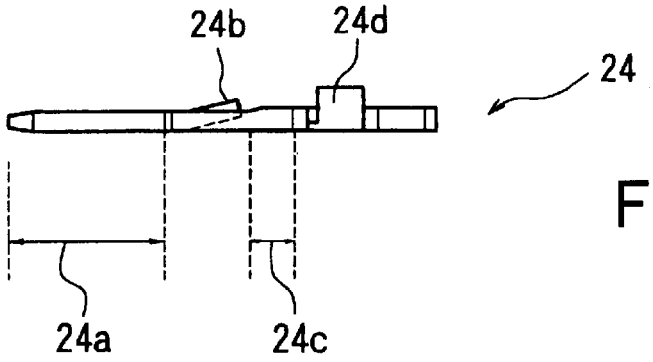
FIG. 7B is a side view of the terminal plate of the reference example.

FIG. 7A is a plan view of a terminal plate 24. FIG. 7B is a side view of the terminal plate 24. As shown in FIGS. 7A and 7B, the terminal plate 24 has, in order from the left-hand side of the figure (i.e. the outside of the pump; the side remote from the fuel pump body), a connector fitting portion 24*a*, a cut and raised portion 24*b* for preventing dislodging, a thick-walled portion 24*c*, and a connecting portion 24*d*. The distal end of the connector fitting portion 24*a* is slightly tapered. This is a portion projecting to the outside of the fuel pump. The cut and raised portion 24*b* is formed by making a U-shaped cut in the center of the terminal plate 24 and raising a portion of the terminal plate 24 surrounded by the U-shaped cut to turn about the side left uncut. As shown in FIG. 7B, the raised portion 24*b* opens toward the pump (right-hand side). The thick-walled portion 24*c* is greater in thickness than the connector fitting portion 24*a*. The connector fitting portion 24*a* has a configuration that gradually increases in thickness toward the right-hand side in the figure. The connecting portion 24*d* is a portion left in the pump to connect with a lead wire of a brush accommodated in the fuel pump body (not shown).

The body upper block 26, shown in FIGS. 8A to 8C, is substantially in the shape of a lidded circular cylinder and liquid-tightly connected to the opening at one end of the fuel pump body (not shown) to close the opening. The body upper block 26 has a pair of terminal plate through-holes 26*x* and an outlet port (not shown). The terminal plate 24 is inserted into one terminal plate through-hole 26*x* from an opening 26*z* provided at the side of the body upper block 26 closer to the fuel pump body (i.e. the right-hand side in the figure). Each terminal plate through-hole 26*x* has a step portion 26*a* and a press-fit portion 26*c*, in order from the side thereof remote from the fuel pump body (i.e. the left-hand side in the figure). The step portion 26*a* is a portion for abutting against the cut and raised portion 24*b* for preventing dislodging of the terminal plate 24. The press-fit portion 26*c* has a sectional configuration somewhat smaller than the sectional configuration of the thick-walled portion 24*c* of the terminal plate 24.

Figure 9A:
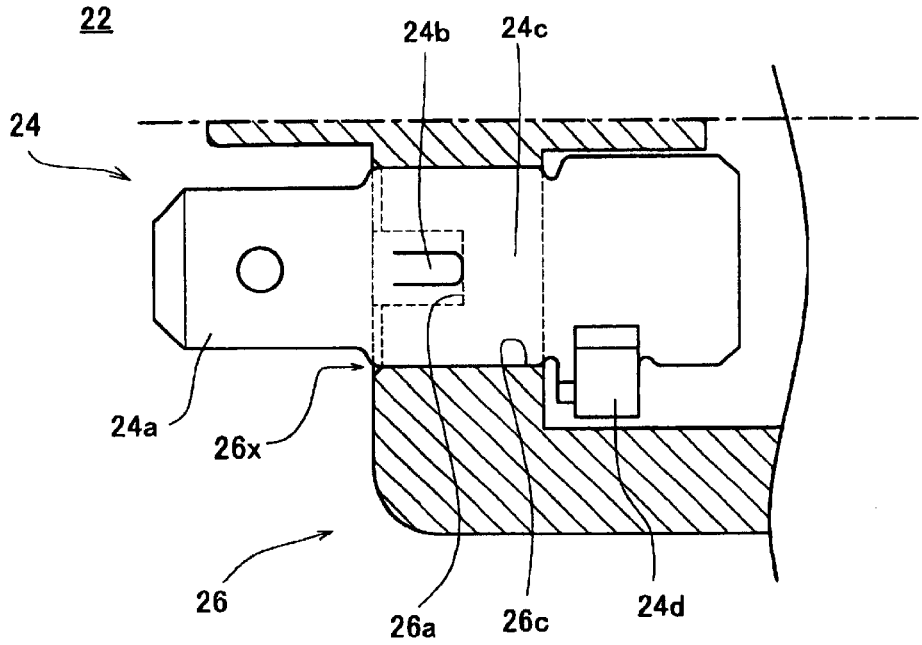
FIG. 9A is a fragmentary sectional view of the terminal plate mounted to the body upper block in the reference example, as seen from the plane of the terminal plate.
Figure 9B:
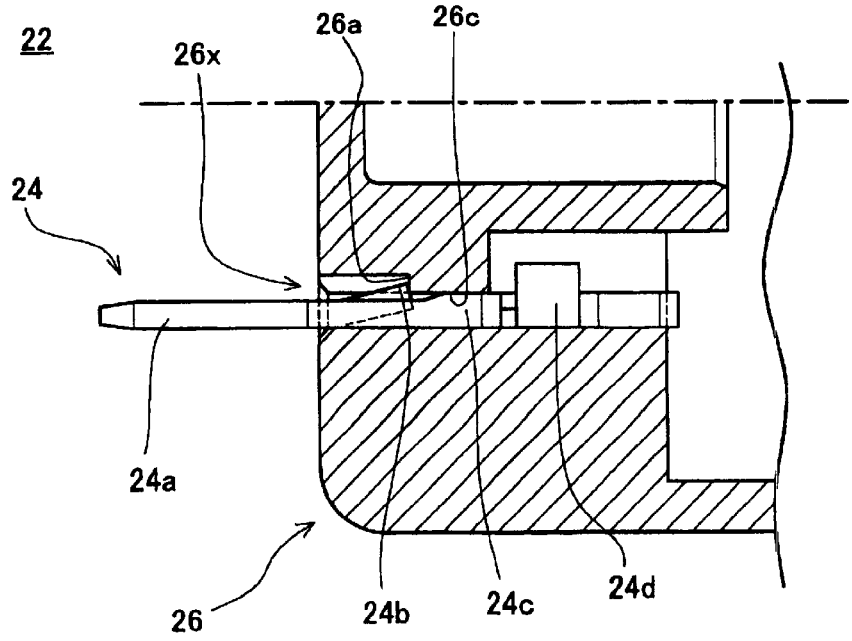
FIG. 9B is a fragmentary sectional view of the terminal plate mounted to the body upper block in the reference example, as seen from a side of the terminal plate.

FIGS. 9A and 9B are diagrams showing the terminal plate 24 mounted to the body upper block 26. The terminal plate 24 is press-fit in the terminal plate through-hole 26*x*, and the thick-walled portion 24*c* of the terminal plate 24 is placed in liquid-tight contact with the press-fit portion 26*c* of the terminal plate through-hole 26*x*. As shown in FIG. 9B in particular, the cut and raised portion 24*b* of the terminal plate 24 abuts against the step portion 26*a* of the body upper block 26 to disable the terminal plate 24 from being pushed back toward the fuel pump body.

In this way, the terminal plate 24 and the body upper block 26 should be capable of being assembled together in a liquid-tight manner. The terminal plate 24 as mounted to the body upper block 26 is prevented from being dislodged by a dislodging preventing mechanism comprising the cut and raised portion 24*b* and the step portion 26*a*. Accordingly, the terminal plate 24 cannot be dislodged to fall into the fuel pump even if a force acts on the terminal plate 24 from the outside of the fuel pump so as to press the terminal plate 24 toward the inside of the fuel pump.

Figure 10:
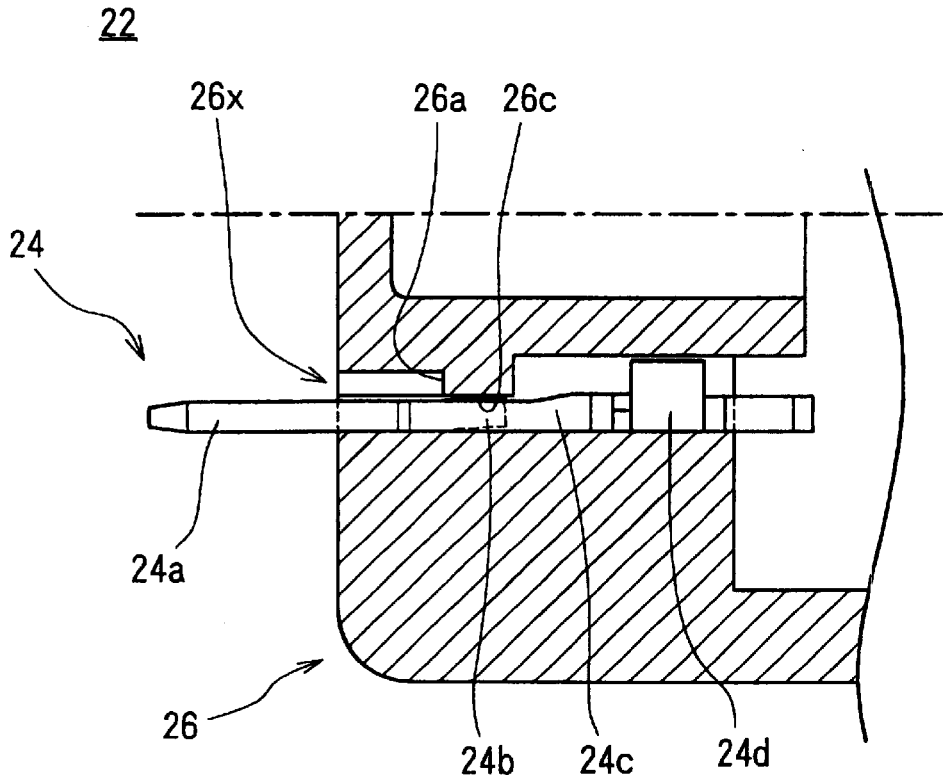
FIG. 10 is a fragmentary sectional view of the terminal plate in the course of being mounted to the body upper block in the reference example, as seen from a side of the terminal plate.
Figure 11A:
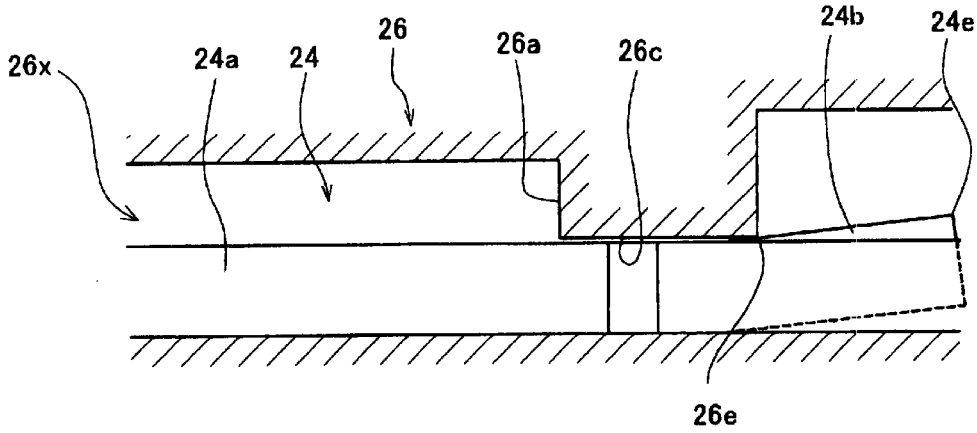
FIGS. 11A to 11C are fragmentary sectional views showing the condition of the terminal plate being mounted to the body upper block in the reference example in three successive stages.
Figure 11B:
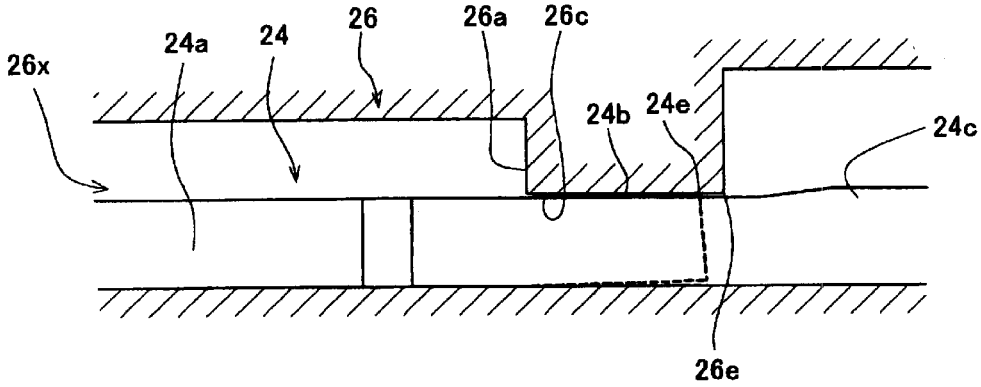
Figure 11C:
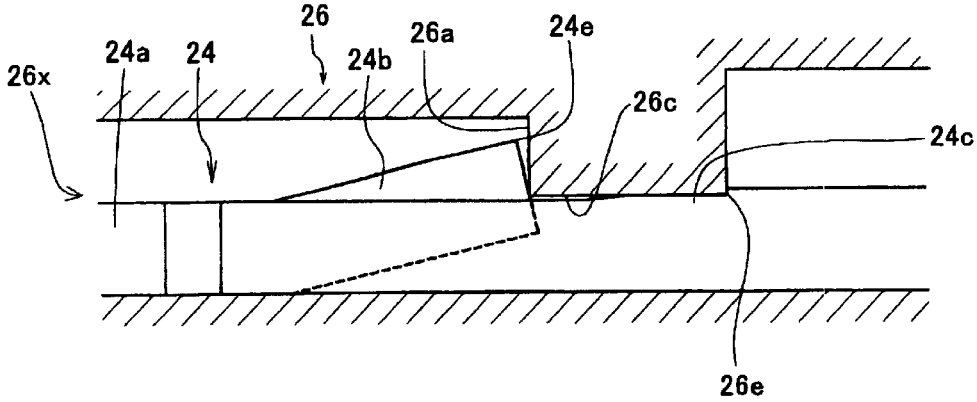

In actual practice, however, there are cases where the required liquid-tightness cannot be ensured. The reason therefor will be described below. FIG. 10 shows a state where the terminal plate 24 is being press-fit into the terminal plate through-hole 26*x*. FIGS. 11A to 11C are enlarged views of the terminal plate through-hole 26*x*. As shown in FIG. 10, the terminal plate 24 is inserted into the terminal plate through-hole 26*x* from the fuel pump body side, i.e. from the right-hand side in the figure. The distal end of the connector fitting portion 24*a* is tapered so that it can pass through the terminal plate through-hole 26*x* easily.

FIGS. 11A to 11C show sequentially the condition of the cut and raised portion 24*b* of the terminal plate 24 moving through the terminal plate through-hole 26*x*. FIG. 11A shows a state where the connector fitting portion 24*a* has passed the press-fit portion 26*c* and the cut and raised portion 24*b* has contacted a corner 26*e* of the press-fit portion 26*c*. FIG. 11B shows a state where the cut and raised portion 24*b* has been closed by being pressed with the corner 26*e* of the press-fit portion 26*c*. After this state has been established, the corner 24*e* of the cut and raised portion 24*b* moves while contacting the inner wall of the press-fit portion 26*c*. FIG. 11C shows a state where the cut and raised portion 24*b* has passed the press-fit portion 26*c* and reached the step portion 26*a*, i.e. the cut and raised portion 24*b* has been released from the pressure applied by the press-fit portion 26*c* and thus allowed to open. At this time, the thick-walled portion 24*c* has reached the press-fit portion 26*c* and hence press-fit therein.

In the above-described example, the terminal plate 24 is provided with the cut and raised portion 24*b* to solve the problem that the terminal plate 24 may be dislodged to fall into the fuel pump when the terminal plate 24 is pushed toward the fuel pump body (not shown in the figure) after it has been mounted to the body upper block 26. However, when the terminal plate 24 is inserted into the terminal plate through-hole 26*x*, the inner wall of the press-fit portion 26*c* may be damaged because the corner 24*e* of the cut and raised portion 24*b* moves while contacting the inner wall of the press-fit portion 26*c*. If there is a flaw in the inner wall of the press-fit portion 26*c*, the thick-walled portion 24*c* cannot come in close contact with the press-fit portion 26*c* of the terminal plate through-hole 26*x* when the former is press-fit into the latter. In such a case, the fuel may leak out through the unwanted gap between the thick-walled portion 24*c* and the press-fit portion 26*c*.

Through the above-described attempts, the present inventors accomplished the following embodiment. The embodiment will be described below with reference to FIGS. 1A to 6D.

Figure 1A:
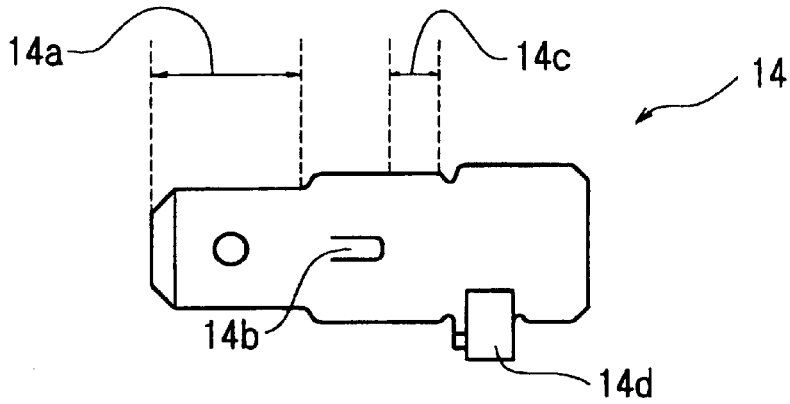
FIG. 1A is a plan view of a terminal plate in the present invention.
Figure 1B:
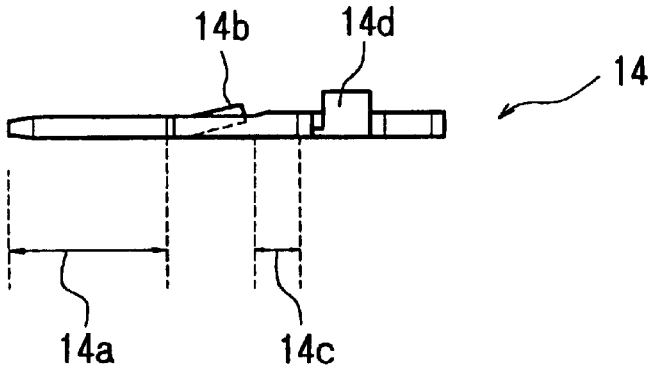
FIG. 1B is a side view of the terminal plate in the present invention.

As shown in FIGS. 1A and 1B, a terminal plate 14 has, in order from the left-hand side of the figure (i.e. the outside of the pump; the side remote from the fuel pump body), a connector fitting portion 14*a*, a cut and raised portion 14*b* for preventing dislodging, a thick-walled portion 14*c*, and a connecting portion 14*d*. The distal end of the connector fitting portion 14*a* is slightly tapered. This is a portion projecting to the outside of the fuel pump. The cut and raised portion 14*b* is formed by making a U-shaped cut in the center of the terminal plate 14 and raising a portion of the terminal plate 14 surrounded by the U-shaped cut to turn about the side left uncut. As shown in FIG. 1B, the raised portion 14*b* opens toward the pump (right-hand side). The thick-walled portion 14*c* is greater in thickness than the connector fitting portion 14*a*. The connector fitting portion 14*a* has a configuration that gradually increases in thickness toward the right-hand side in the figure. The connecting portion 14*d* is a portion left in the pump to connect with a lead wire of a brush accommodated in the fuel pump body (not shown).

Figure 2:
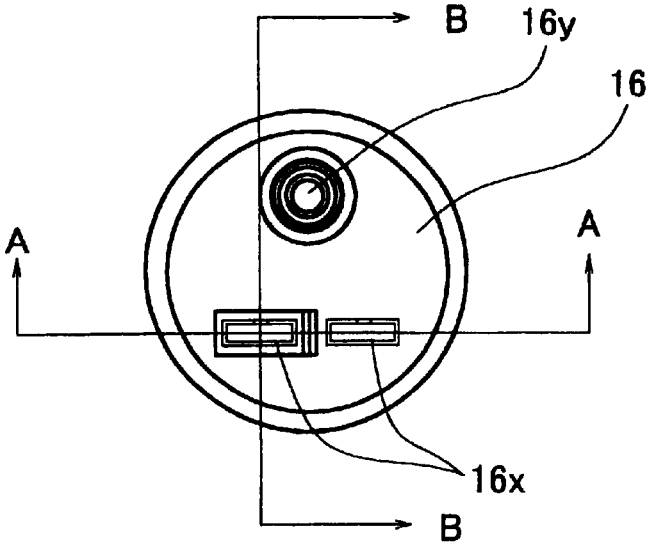
FIG. 2 is a plan view of a body upper block in the present invention.
Figure 3A:
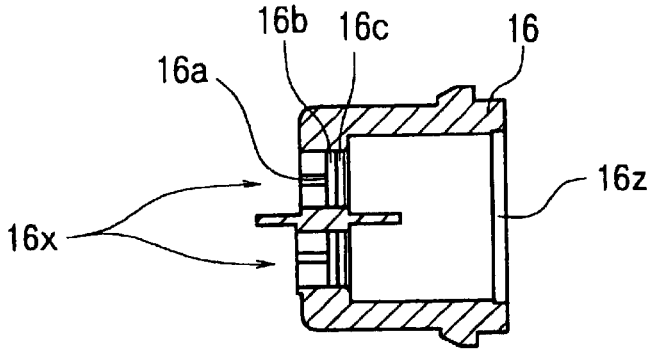
FIG. 3A is a sectional view taken along the line A—A in FIG. 2.
Figure 3B:
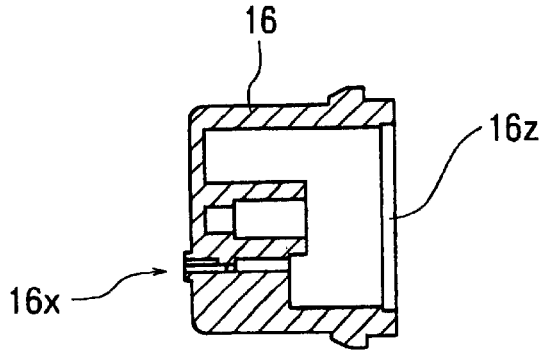
FIG. 3B is a sectional view taken along the line B—B in FIG. 2.
Figure 3C:
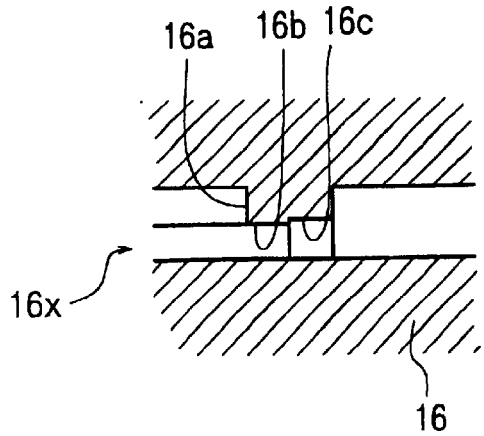
FIG. 3C is an enlarged view of an essential part of FIG. 3B.

A body upper block 16, shown in FIGS. 2 and 3A to 3C, is substantially in the shape of a lidded circular cylinder and liquid-tightly connected to the opening at one end of the fuel pump body (not shown) to close the opening. As shown in FIG. 2, the body upper block 16 has a pair of terminal plate through-holes 16*x* and an outlet port 16*y*. The terminal plate 14 is inserted into one terminal plate through-hole 16*x* from an opening 16*z* provided at the side of the body upper block 16 closer to the fuel pump body (i.e. the right-hand side in the figure). Each terminal plate through-hole 16*x* has a step portion 16*a*, a projection 16*b* and a press-fit portion 16*c*, in order from the side thereof remote from the fuel pump body (i.e. the left-hand side in the figure). The step portion 16*a* is a portion for abutting against the cut and raised portion 14*b* for preventing dislodging of the terminal plate 14. The step portion 16*a* engages with the cut and raised portion 14*b* in its natural configuration to prevent it from being dislodged. The projection 16*b* is the narrowest portion in the terminal plate through-hole 16*x*, which has a configuration that allows the connector fitting portion 14*a* to pass therethrough but disables the cut and raised portion 14*b* from passing therethrough unless it is closed. The press-fit portion 16*c* has a sectional configuration somewhat smaller than the sectional configuration of the thick-walled portion 14*c* of the terminal plate 14.

Figure 4A:
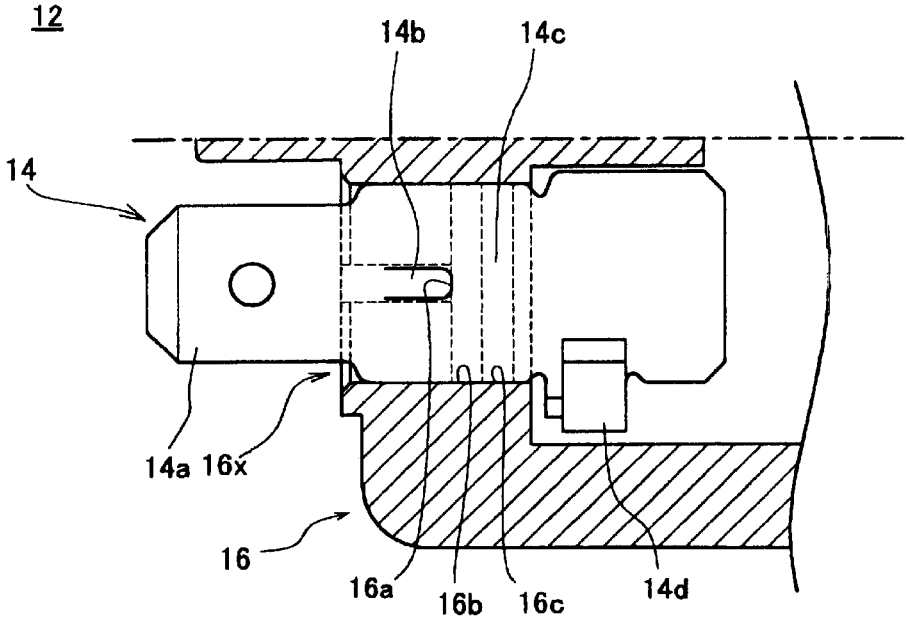
FIG. 4A is a fragmentary sectional view of the terminal plate mounted to the body upper block in the present invention, as seen from the plane of the terminal plate.
Figure 4B:
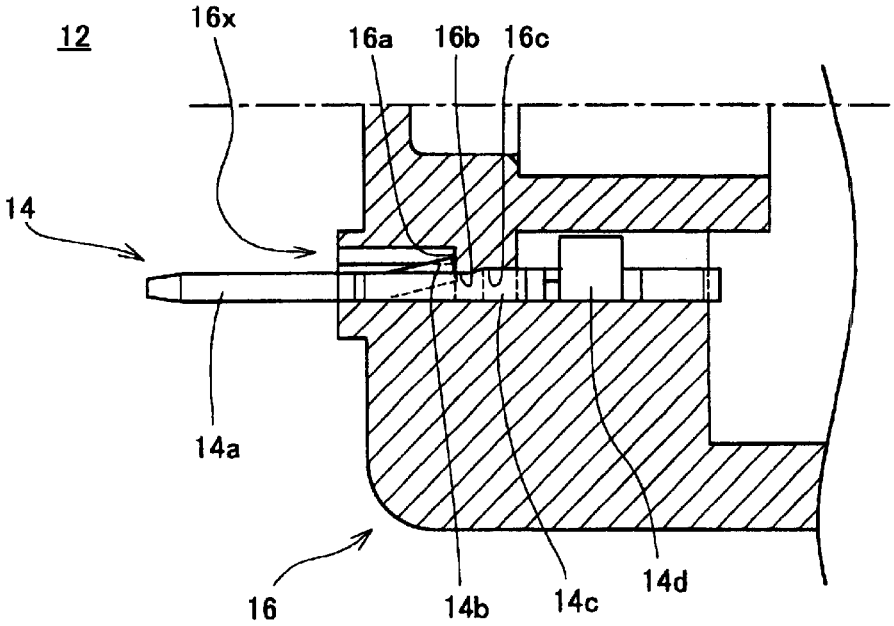
FIG. 4B is a fragmentary sectional view of the terminal plate mounted to the body upper block in the present invention, as seen from a side of the terminal plate.
Figure 5:
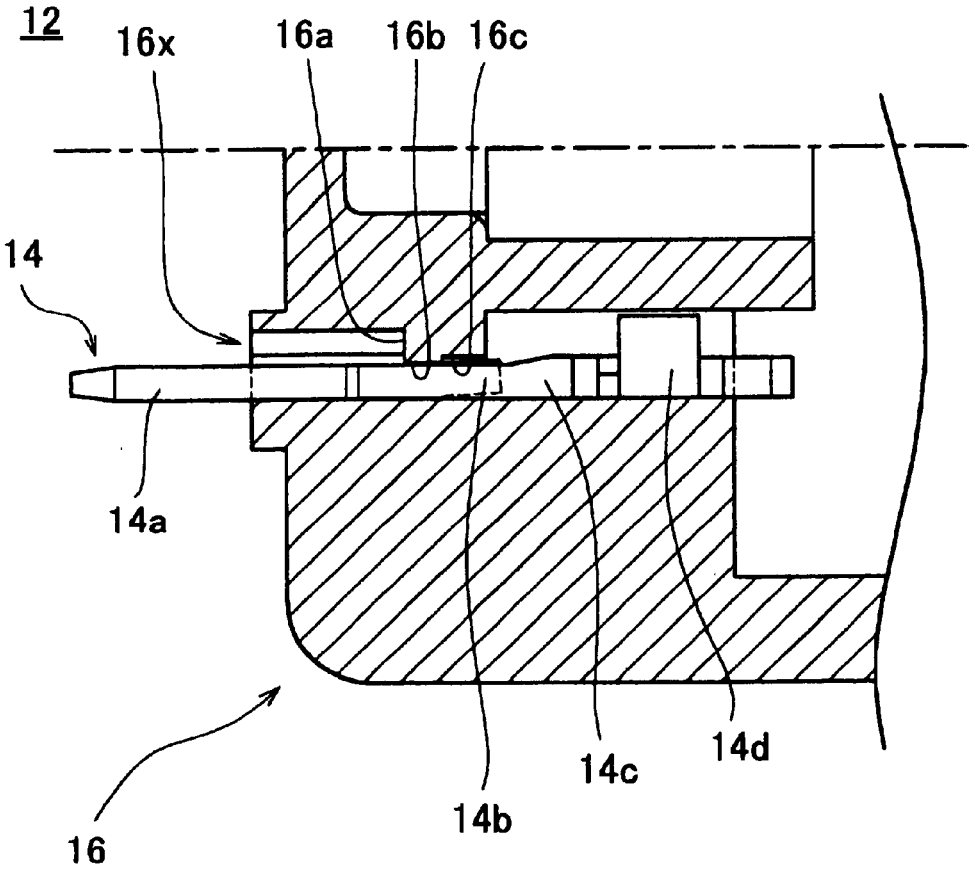
FIG. 5 is a fragmentary sectional view of the terminal plate in the course of being mounted to the body upper block in the present invention, as seen from a side of the terminal plate.

FIGS. 4A and 4B are diagrams showing the terminal plate 14 mounted to the body upper block 16. The terminal plate 14 is press-fit in the terminal plate through-hole 16*x*, and the thick-walled portion 14*c* of the terminal plate 14 is placed in liquid-tight contact with the press-fit portion 16*c* of the terminal plate through-hole 16*x*. As shown in FIG. 4B in particular, the cut and raised portion 14*b* of the terminal plate 14 abuts against the step portion 16*a* of the body upper block 16 in its natural configuration to disable the terminal plate 14 from being pushed back toward the fuel pump body.

By virtue of the above-described characteristic configuration, the terminal plate 14 and the body upper block 16 can be liquid-tightly mounted to the fuel pump according to this embodiment. In addition, the terminal plate 14 and the body upper block 16 have a mechanism that prevents the terminal plate 14 from being dislodged to fall into the fuel pump even if it is pressed toward the fuel pump body from the side remote from it. The dislodging-preventing mechanism does not depend on other component parts.

Figure 6A:
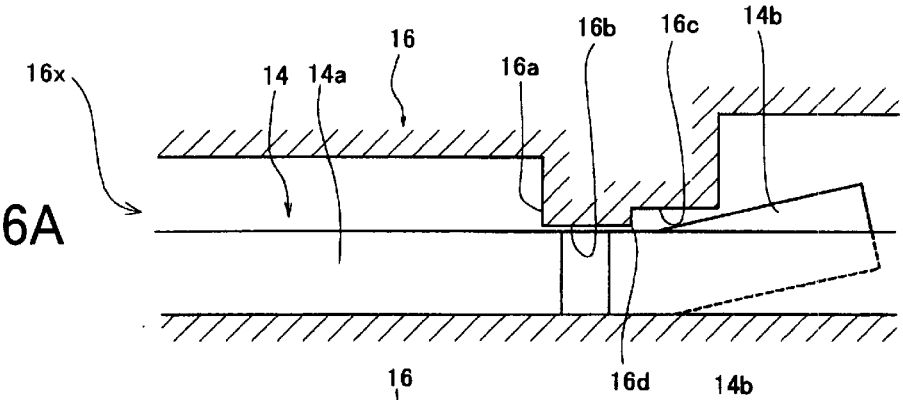
FIGS. 6A to 6D are fragmentary sectional views showing the condition of the terminal plate being mounted to the body upper block in the present invention in four successive stages.
Figure 6B:
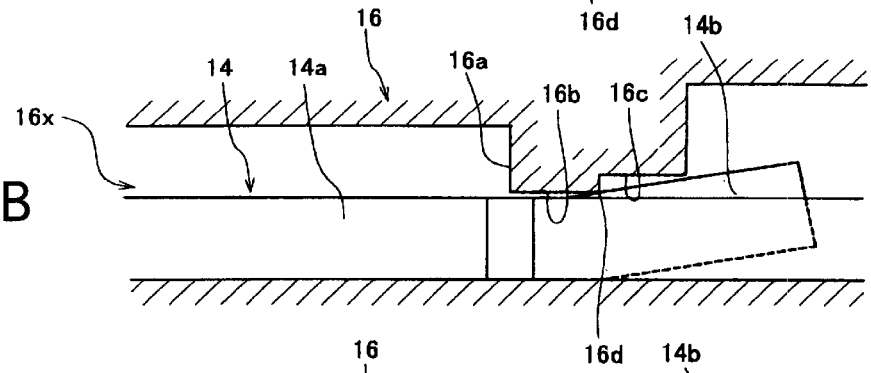
Figure 6C:
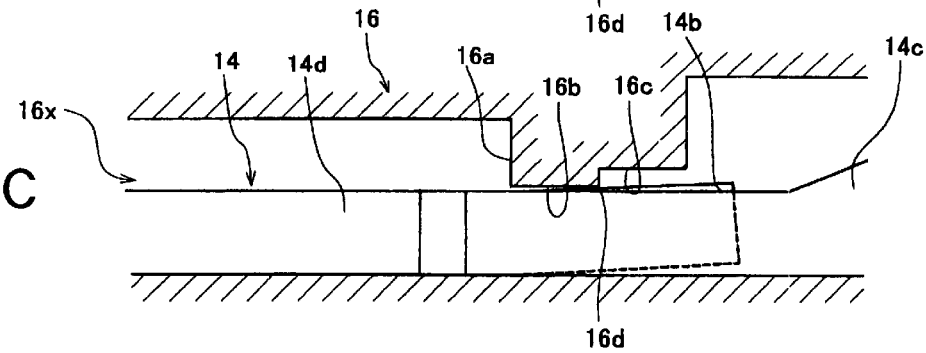
Figure 6D:
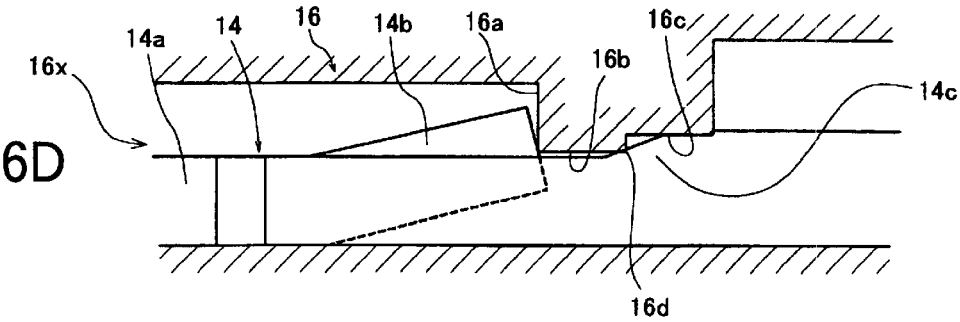

Next, the condition of the terminal plate 14 in the course of being press-fit into the terminal plate through-hole 16*x* will be described with reference to FIG. 5 and FIGS. 6A to 6D. FIGS. 6A to 6D show sequentially the condition of the cut and raised portion 14*b* of the terminal plate 14 moving through the terminal plate through-hole 16*x*. FIG. 6A shows a state where the connector fitting portion 14*a* has passed the projection 16*b*. At this time, the cut and raised portion 14*b* is in its natural configuration and not in contact with the inner wall of the terminal plate through-hole 16*x*. FIG. 6B shows a state where the cut and raised portion 14*b* has contacted a corner 16*d* of the projection 16*b*. It should be noted that there is no possibility of the cut and raised portion 14*b* contacting the press-fit portion 16*c* before the cut and raised portion 14*b* contacts the corner 16*d* of the projection 16*b*. FIG. 6C shows a state where the cut and raised portion 14*b* has contacted the corner 16*d* of the projection 16*b* and closed by being pressed with the projection 16*b*. At this time, the cut and raised portion 14*b* is closed by being pressed with the projection 16*b* to an angle at which the cut and raised portion 14*b* can pass without contacting the press-fit portion 16*c*. FIG. 6D shows a state where the cut and raised portion 14*b* has passed the projection 16*b* and reached the step portion 16*a*, i.e. the cut and raised portion 14*b* has been released from the pressure applied by the projection 16*b* and thus allowed to open to its natural configuration. At this time, the thick-walled portion 14*c* has reached the projection 16*b* and the press-fit portion 16*c* and hence press-fit therein.

In this embodiment, the projection 16*b* is provided adjacent to the press-fit portion 16*c* of the terminal plate through-hole 16*x*. The cut and raised portion 14*b* of the terminal plate 14 comes in contact with the projection 16*b* without contacting the press-fit portion 16*c* and is closed by being pressed with the corner 16*d* of the projection 16*b*. The cut and raised portion 14*b* moves while being kept closed until it reaches the step portion 16*a*. Therefore, the cut and raised portion 14*b* does not contact the press-fit portion 16*c* at all. Hence, there is no possibility of the cut and raised portion 14*b* damaging the press-fit portion 16*c*. Accordingly, the terminal plate 14 can be placed in liquid-tight contact with the terminal plate through-hole 16*x* of the body upper block 16 even more reliably.

In the fuel pump according to the present invention, the terminal plate can be mounted to the body upper block without damaging the press-fit portion of the terminal plate through-hole. Accordingly, the terminal plate and the body upper block can be reliably assembled together in a liquid-tight manner. In addition, the terminal plate can be prevented from being dislodged from the body upper block to fall into the fuel pump without the need of other component parts.

Although one embodiment of the present invention has been detailed above, it should be noted that the described embodiment is for illustrative purpose only and is not to be taken to limit the scope of the appended claim. The technique set forth in the claim includes various changes and modifications of the foregoing embodiment.

Further, the technical elements described in this specification or in the drawings exhibit technical utility singly or in various combinations and are not limited to the combination recited in the claim as filed. The techniques illustrated in this specification or in the drawings attain a plurality of purposes simultaneously, and attaining one of the purposes per se offers technical utility.

What is claimed is:

1. A fuel pump comprising:

an approximately cylindrical fuel pump body in which a fuel pump part and a driving motor part are mounted; and a body upper for closing one end of said fuel pump body;

said body upper having a body upper block made of a resin material and a terminal plate extending through said body upper block;

said terminal plate having, in order from a side thereof remote from said fuel pump body, a connector fitting portion projecting from said body upper block to an outside of said fuel pump; a cut and raised portion opening toward said fuel pump body; and a thick-walled portion greater in thickness than said connector fitting portion;

said body upper block having an outer shape for closing the one end of said approximately cylindrical fuel pump body, said body upper block further having a terminal plate through-hole;

wherein said terminal plate through-hole has, in order from a side thereof remote from said fuel pump body, a step portion for abutting against said cut and raised portion opening toward said fuel pump body; a projection for contacting said cut and raised portion to close cut and raised portion; and a press-fit portion for liquid-tightly contacting said thick-walled portion.

* * * * *